United States Patent [19]

Masso Remiro

[11] 4,037,606

[45] July 26, 1977

[54] WOMAN'S CORRECTING GARMENT

[75] Inventor: Jose Maria Masso Remiro, Barcelona, Spain

[73] Assignee: Turbo, S.A., Barcelona, Spain

[21] Appl. No.: 633,722

[22] Filed: Nov. 20, 1975

[30] Foreign Application Priority Data

Nov. 25, 1974 Spain ..... 207837

[51] Int. Cl.[2] ..... A41C 1/00

[52] U.S. Cl. ..... 128/547

[58] Field of Search ..... 128/521, 546, 547, 518 R, 128/548, 550, 432–440, 544, 577

[56] References Cited

U.S. PATENT DOCUMENTS 3,253,597 5/1966 Spanel ..... 128/521

3,327,707 6/1967 Storti ..... 128/546 X 3,489,154 1/1970 Kaspar et al. ..... 128/521

*Primary Examiner*—G. V. Larkin

*Attorney, Agent, or Firm*—Ladas, Parry, Von Gehr, Goldsmith & Deschamps

[57] ABSTRACT

A correcting garment comprises a tubular body adapted to cover an anatomical region below the wearer's chest, the tubular body being constituted by superimposed inner and outer tubular sheets of fabric joined together by a layer of latex. The tubular sheets are elastic in the widthwise direction and are so arranged that on transverse expansion of the sheets they tend to undergo longitudinal rolling in opposite directions, whereby the tendency of the two sheets to roll is neutralized.

2 Claims, 2 Drawing Figures

A-B

WOMAN'S CORRECTING GARMENT

The present invention relates to correcting garment.

Heretofore a woman, due to her constitution or physical condition, has been obliged to use a one-piece girdle or, in its absence, a two-piece girdle composed of an upper part and a lower part in order to mold her figure completely.

Both these correcting garments present a problem arising from the wearer's height, since the brassiere is incorporated in the garment, in the case of a one-piece girdle, or else in the upper part, in the case of a two-piece girdle. In the case of a one-piece girdle, since the height of the user is independent of the width of the garment, it is frequently found, that the bosom is badly shaped and adopts an incorrect position since the cups of the brassiere are too low, or the bosom is pushed upwards, whereby the shape of the user is rather disfigured.

This defect does not take place in the case of a two-piece girdle, but the parts either overlap or they become separated. When they overlap a painful pressure zone is produced, which occurs due to the correcting action of both parts simultaneously. When the two parts are separated, an intermediate zone, lacking in pressure, is produced, giving rise to an unsightly bulge at the level of the waist.

Moreover, these prior garments are stiffened by ribs and seams which are very uncomfortable for the user, thus preventing her from adopting certain postures, producing a stiffness perceptible from the outside. The ribs may even produce sores, creating, therefore, physical, mental and traumatic conditions in the user.

Up to now there has been no other solution but to accept these consequences, since tubular garments have proved inefficient due to the rolling produced thereby.

In fact, since these garments are elastic widthwise, when they expand radially they tend to shrink and this results in a rolling effect, thus producing such an uncomfortable sensation that the user refrains from using them.

Therefore, the object of the present invention consists in achieving a woman's tubular correcting garment in which rolling does not take place.

Generally speaking, the woman's garments are comprised of a tubular body made from two sheets of cloth, superficially joined, which sheets are rolled in opposite directions neutralizing the rolling tendency. The two sheets of cloth are joined by a thin layer of latex and constitute an elastic and neutral joining.

A set of drawings is attached to the present specification, wherein the following is represented.

Figure 1:
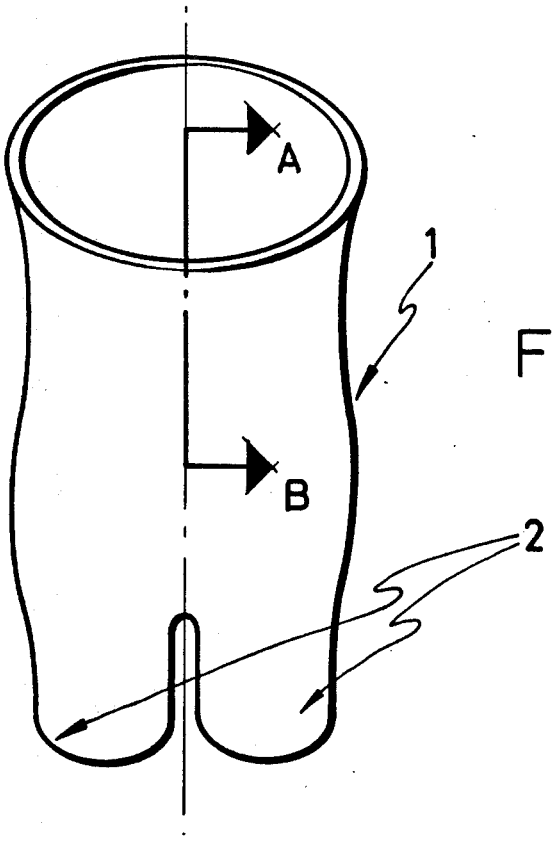

FIG. 1 illustrates a perspective view of a woman's correcting garment.

Figure 2:
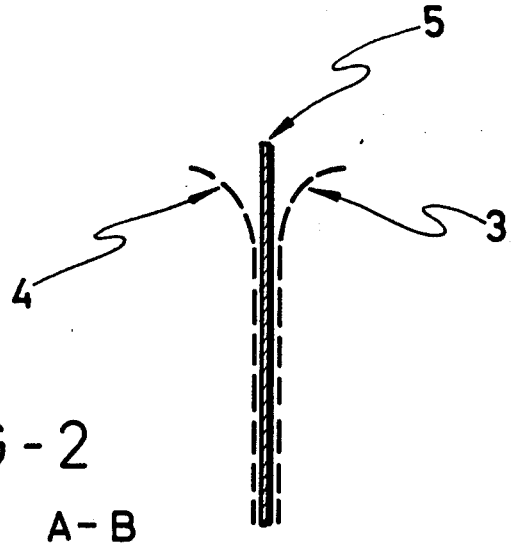

Finally, FIG. 2 corresponds to a sectional view of the preceding figure taken long cut line *a-b*.

As can be seen from the drawing, the illustrated correcting garment is constituted of a tubular body 1, provided with leg portions 2. The garment covers an anatomical region comprised between the thighs and the lower part from where the bosom begins.

The tubular body 1 comprises two sheets of cloth 3 and 4, which are elastic in the widthwise direction and are joined to each other by placing therebetween a layer of latex 5; the sheets of cloth 3 and 4 are so arranged that the tendency to longitudinal rolling, produced as a result of the transverse expansion of the cloth, takes place in opposite directions, and accordingly the tendency of each sheet to roll is neutralized by the other sheet.

This form of garment is highly efficient for a correcting effect; and it does not require reinforcing seams or ribs, is independent of the brassiere and covers a zone which leaves the bosom free while it surrounds the trunk, waist, buttock and thighs.

The process to obtain a correcting garment made from a tubular knitted cloth, is as follows:

A pre-shaped templet is introduced, the openings are closed, and the assembly is immersed in a latex bath at a temperature between 18° and 40° C.

Immersion should be conducted with a very open angle so that it takes place parallel to the surface and at a depth of 5 to 10 cms. The low pressure adheres the latex tangentially, not by absorption but by gripping of the latex to the roughness formed by the chains of stitches constituting the knitted fabric.

Subsequently, the layer of latex is dried at ambient or elevated temperature, depending on the time and the vulcanization process after drying.

In the case of non-tubular or open fabric, the layer of latex is applied at the same temperature as before by transference, with coating rollers or by spreading the layer of latex using scrapers or blades. In this case, the adherence characteristic of the latex is the same, i.e. tangential without penetration, and vulcanization is somewhat quicker.

Naturally, the process is carried out continuously.

One the coated sheets are obtained, their non-coated surfaces are placed face-to-face and they are joined by means of a layer of latex.

To prevent rolling, it is essential that the direction of rolling be detected before-hand and that the sheets be arranged in such a way that that one sheet tends to roll in the opposite direction to the other.

I claim:

1. A correcting garment, comprising a tubular body adapted to cover an anatomical region below the wearer's chest, said tubular body being consituted by superimposed inner and outer tubular sheets of fabric joined together by a layer of latex therebetween, said tubular sheets being elastic in the transverse direction, and each sheet having a tendency to undergo longitudinal rolling when it is subjected to transverse stretching, one sheet tending to roll towards the interior of the garment while the other sheet tends to roll towards the exterior thereof, whereby the tendency of said one sheet to roll neutralizes the tendency of said other sheet to roll and vice versa.

2. A correcting garment as claimed in claim 1, wherein the tubular body is provided with leg portions and the garment is adapted to cover an anatomical region between the wearer's thighs and the wearer's chest.

* * * * *